US005105645A

United States Patent [19]

Kobayashi et al.

[11] Patent Number: 5,105,645

[45] Date of Patent: Apr. 21, 1992

[54] METHOD OF REDRAWING METAL CUP

[75] Inventors: Tomomi Kobayashi; Akira Kobayashi; Katsuhiro Imazu, all of Yokohama, Japan

[73] Assignee: Toyo Seikan Kaisha, Ltd., Tokyo, Japan

[21] Appl. No.: 611,636

[22] Filed: Nov. 13, 1990

[30] Foreign Application Priority Data

Nov. 13, 1989 [JP] Japan ..... 1-292457

[51] Int. Cl.[5] ..... B21D 22/28

[52] U.S. Cl. ..... 72/348; 72/379.4

[58] Field of Search ..... 72/347, 348, 349, 379.4

[56] References Cited

U.S. PATENT DOCUMENTS 1,942,930 1/1934 Ludington ..... 72/349

4,425,778 1/1984 Franek et al. ..... 72/349

*Primary Examiner*—Lowell A. Larson

*Attorney, Agent, or Firm*—Sughrue, Mion, Zinn, Macpeak & Seas

[57] ABSTRACT

Disclosed is a method of redrawing a metal cup, in which an annular working member is used together with a redrawing die, a redrawing punch and a cup-shaped holding member, and this annular working member has a working face having an inner diameter smaller than the outer diameter of a preliminarily drawn cup to be redrawn. If redrawing is carried out by using this annular working member, the thickness of the drawn cup can be uniformly and sufficiently reduced without damaging a metal sheet of the preliminarily drawn cup or a coating layer thereof.

5 Claims, 6 Drawing Sheets

FIG. 3-A
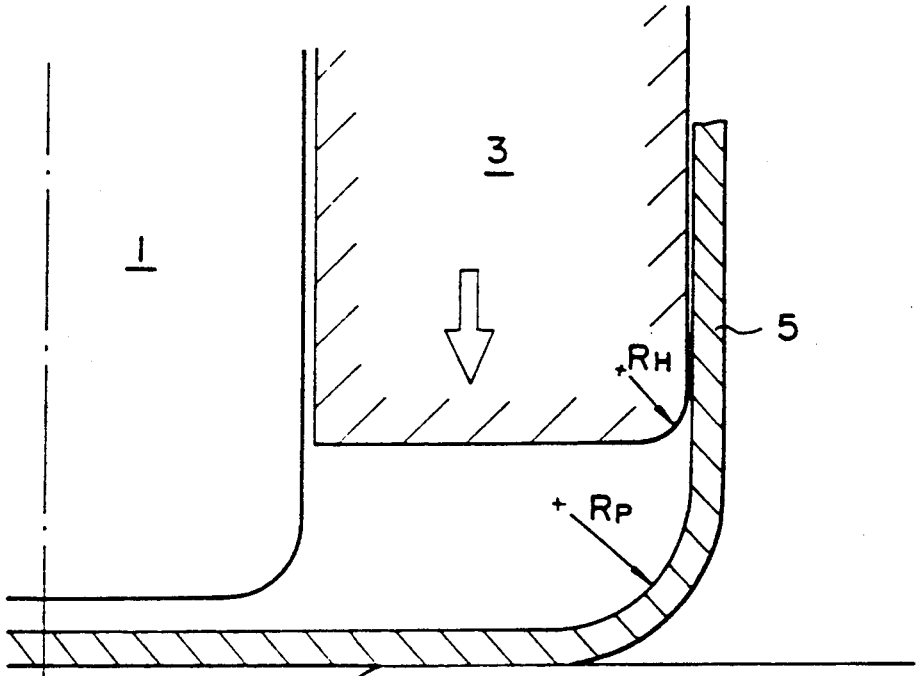
FIG. 3-B
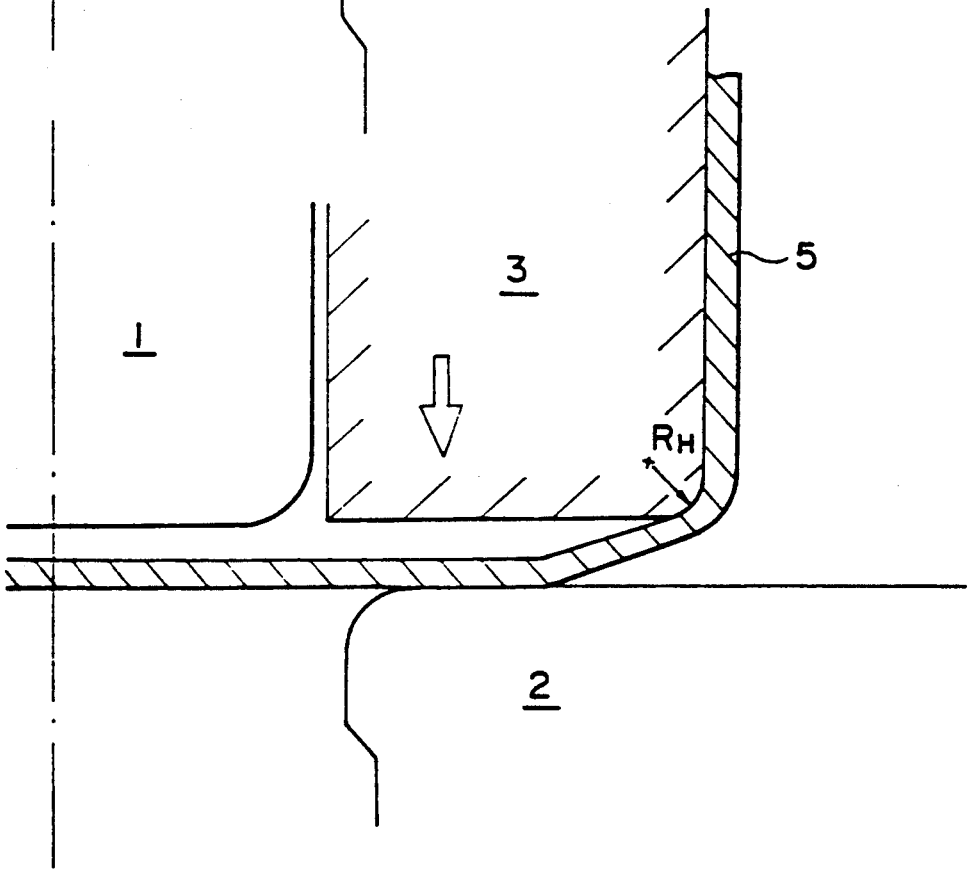

METHOD OF REDRAWING METAL CUP

BACKGROUND OF THE INVENTION (1) Field of the Invention

The present invention relates to a method of redrawing a metal cup. More particularly, the present invention relates to a redrawing method of preparing a uniformly thickness-reduced can barrel from a preliminarily drawn cup of a metal sheet, especially a coated metal sheet, while moderating the damage of the metal sheet and the coating layer and controlling the advance of the work hardening.

(2) Description of the Related Art

The production of a seamless can barrel by subjecting a metal sheet or a coated metal sheet to drawing and redrawing has been conducted from old. At the draw-redraw forming, the metal sheet shows such a plastic flow that the size of the can is increased in the height direction but the size is diminished in the circumferential direction of the can barrel.

According to the conventional redrawing method, the redraw forming is accomplished by relatively moving a punch having a diameter smaller than that of a preliminarily drawn cup drawn in advance to have a large diameter and a redrawing die so that the punch and die are engaged with each other. An annular cup-holding member is arranged within the preliminarily drawn cup, and a bottom face of the preliminarily drawn cup is held by the holding member and the flat face portion of the redrawing die. At the redrawing step, the holding member is moved synchronously with the redrawing die.

In this structure, at the relative movement of the punch and the die, the preliminarily drawn cup is draw-formed into a deep-draw-formed cup having a small diameter by a curvature corner portion of the redrawing die and simultaneously, the side wall of the preliminarily drawn cup is bent and elongated and the thickness of the side wall is reduced. At the deep-draw forming, the holding member and the flat face portion of the redrawing die act as the blank holding face to a portion of the cup on which influences of the plastic flow are imposed.

Various methods of sufficiently reducing the thickness of a deep-draw-formed cup and uniformly reducing the thickness of the side wall of the cup have been proposed in the conventional thickness-reducing redrawing process (see, for example, Japanese Unexamined Patent Publication No. 56-501442 and Japanese Unexamined Patent Publication No. 01-258822).

These thickness-reducing redrawing methods are characterized in that the curvature of the corner portion of the redrawing die is specifically adjusted, and by reducing the curvature of the corner portion, the thickness of the deep-draw-formed cup is reduced uniformly and sufficiently. However, if the curvature of the corner portion of the redrawing die is reduced, the risk of damage of the metal sheet and coating layer increases and the adhesion between the coating layer and the metal sheet tends to decrease. Accordingly, in a final canned product, troubles such as corrosion of the metal and elution of the metal are caused, and a swollen can is formed by generation of hydrogen or a leaking can is formed by pitting.

In order to obtain a large thickness reduction ratio (1—can barrel thickness/blank thickness), it is necessary to set the radius of the redrawing die and the radius $R_H$ of the holding member at smaller values or to apply a larger blank holding force. However, in the case where the surface of the material is coated, the bearing pressure imposed on the coating surface rises and it is apprehended that the coating will be fatally damaged. Furthermore, in the case where the side wall face of the preliminarily drawn cup is arranged on the blank holding face, the space from the blank holding face is equal to the maximum sheet thickness in the blank holding face, and therefore, if a cup having an uneven thickness distribution is redrawn, the blank holding force is concentrated on the peripheral side of the blank holding face where the thickness is largest, while no satisfactory blank holding effect is obtained on the inner circumferential side of the blank holding face, and traces of wrinkles are sometimes left on the redraw-formed cup.

In the case where a draw-redraw-formed cup is processed in a vessel for a canned product, the cup is then subjected to beading, necking and flanging of the side wall. In general, in the side wall of the draw-redraw-formed can barrel, work hardening is caused by plastic deformation and the yield point becomes larger than that of the starting blank, and therefore, there is observed a tendency that the above-mentioned post treatments are not advantageously performed. This work hardening is especially conspicuous in the vicinity of the open end of a cup obtained from a high-strength steel sheet as the starting blank at high draw and redraw ratios, and the above-mentioned undesirable tendency is prominent in this cup.

SUMMARY OF THE INVENTION

It is therefore a primary object of the present invention to provide a redrawing method of producing a deep-draw-formed can, in which the thickness is uniformly and sufficiently reduced even if the curvature radius of the redrawing die and the curvature radius (blank holder radius) of the corner portion of the holding member are set at larger values.

Another object of the present invention is to provide a redrawing method in which damage of a metal sheet or coating is reduced.

Still another object of the present invention is to provide a redrawing method in which work hardening is controlled in the redraw-formed cup and post treatments of the redraw-formed cup, such as necking, are facilitated.

In accordance with the present invention, there is provided a method of redrawing a metal cup, which comprises holding a preliminarily drawn cup of a metal sheet by a cup-holding member inserted in the cup and a flat face portion of a redrawing die, and relatively moving the redrawing die and a redrawing punch arranged coaxially with the holding member and the redrawing die and movably within the holding member, wherein an annularly working member coaxial with the cup-holding member, which has a working face having an inner diameter smaller than the outer diameter of the side wall of the preliminary drawn cup, is arranged on the introduction side of the flat face portion of the redrawing die, the preliminarily drawn cup is passed through the working face of the annular working member to diminish the outer diameter of the cup, and subsequently, redraw forming of the cup is carried out by the redrawing die and the redrawing punch while a blank holding force is being applied to the cup by the holding member and the flat face portion of the redrawing die.

In the present invention, it is especially preferred that the outer diameter of the preliminarily drawn cup is diminished by 1 to 6% by the annular working member.

BRIEF DESCRIPTION OF THE DRAWINGS

FIGS. 3-A and 3-B are sectional partial views illustrating the problems to be solved.

DETAILED DESCRIPTION OF THE INVENTION

The redrawing method of the present invention will now be described.

Figure 1:
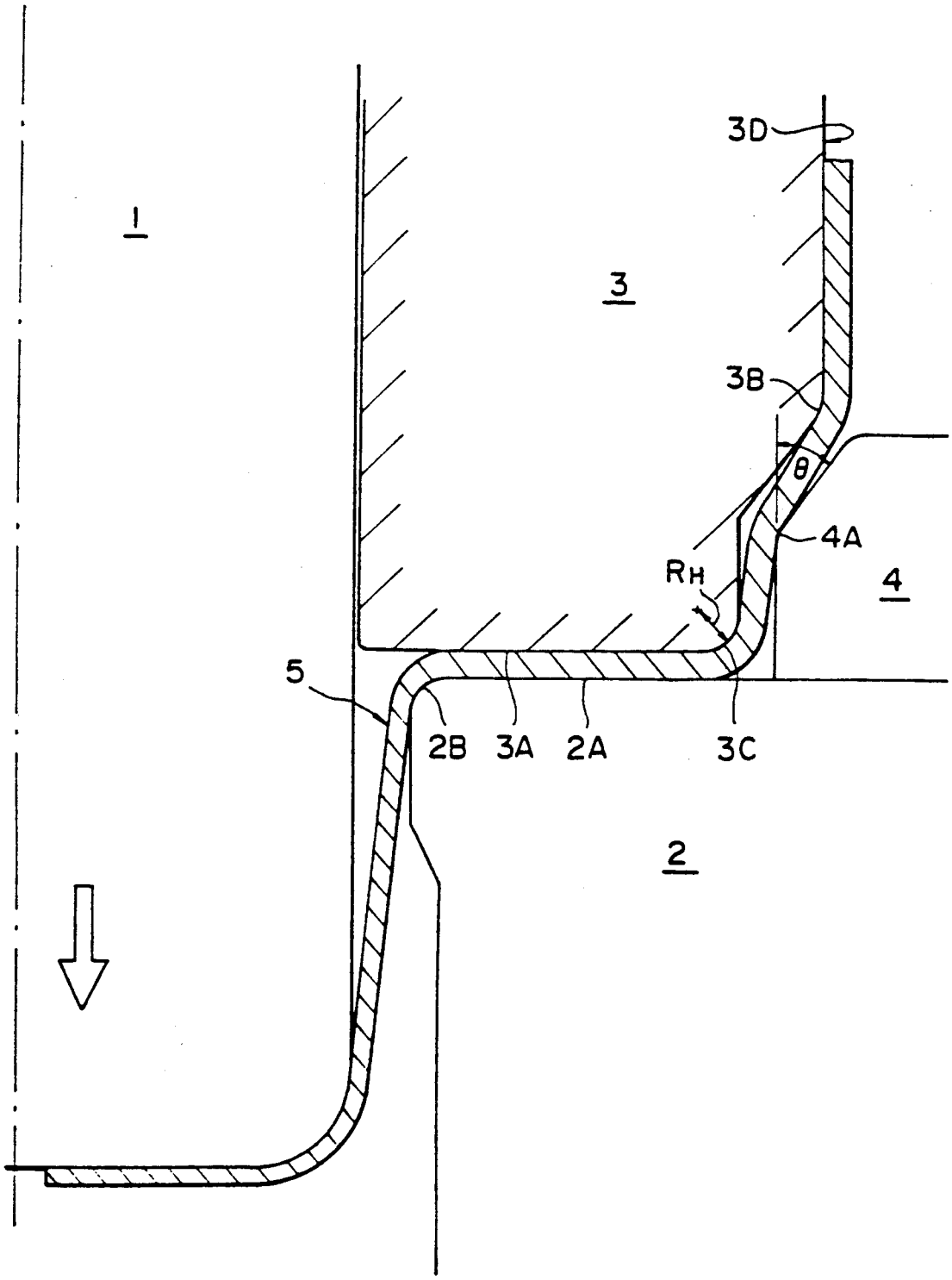
FIGS. 1 and 2 are sectional views showing the main part, which illustrate the redrawing method of the present invention.

Referring to FIG. 1, a redrawing punch 1, a redrawing die 2, a holding member 3 and an annular working member 4 are used in the redrawing method. The redrawing punch 1 is arranged so that the redrawing punch can be moved relatively to the redrawing die 3 and holding member 3, and the redrawing die 2 and annular holding member 3 are arranged with a certain space therebetween according to the thickness of a preliminarily drawn cup (cup drawn at the preceding step) 5. The annular working member 4 is arranged on the introduction side of the redrawing die 2. In the redrawing die 2, the flat face portion of the redrawing die constitutes a top end face 2A of the redrawing die 2, and in the holding member 3, a small-diameter lower end face 3A of the holding member constitutes a blank holding face. In the annular working member 4, a working portion 4A is formed on the inner wall of the working member 4, and the diameter of the working portion is smaller than the outer diameter of the side wall of the preliminarily drawn cup to be used.

In the present invention, a working face having a diameter smaller than the diameter of the preliminarily drawn cup is disposed on the introduction side of the flat portion of the redrawing die, and at the redrawing step, at first, the preliminarily drawn cup is passed within the working face to diminish the outer diameter of the preliminarily drawn cup and then, redraw forming is carried out while a blank holding force is being applied by the holding member and the flat face of the redrawing die, whereby damage of the metal sheet or coating layer of the redraw-formed cup is drastically reduced.

Furthermore, in the present invention, prior to redraw forming, the diameter of the preliminarily drawn cup is diminished by the working face and the hardness of the portion to be processed is reduced, and therefore, the post processing of the redrawn cup is greatly facilitated.

In the present invention, at first, the side wall of the preliminarily drawn cup undergoes a working action of the working portion of the annular working member, with the result that the diameter of the preliminarily drawn cup is diminished. At this point, the side wall of the cup undergoes a bending-unbending action of a curved part of the large-diameter portion of the holding member and a working portion of the annular member. Then, the side wall of the cup, which has undergone such actions, receives a blank holding force from a small-diameter corner portion 3C of the holding member, and also receives a bending resistance when the side wall of the cup is introduced into the clearance of the blank holding face. Furthermore, when the side wall of the cup receives this bending resistance, a tension from the working face of the preceding stage is imposed. After the side wall of the cup has passed through the blank holding face, the side wall of the cup is bent and elongated by a corner portion 2B of the redrawing die. Also in this case, a back tension is applied to the side wall at the corner portion 2B.

In the above-mentioned structure, at first, the diameter of the preliminarily drawn cup is diminished. Accordingly, the difference of the thickness of the cup between the peripheral side and inner circumferential side of the blank holding face is reduced, and the blank holding force acts effectively. Furthermore, also the area of the blank holding face is reduced and the blank holding force can be reduced.

Furthermore, in the present invention, the holding member is inserted into the preliminarily drawn cup, and when the cup receives a pressing force from a small-diameter corner portion 4C of the holding member, the peripheral portion of the bottom of the preliminarily drawn cup has already received a compression deformation in the circumferential direction from the working portion 4A of the annular member. In the conventional technique, the optimum range of the punch radius $R_P$ at the forming of the preliminarily drawn cup is different from the optimum range of the radius $R_H$ (blank holder radius) of the corner portion 3C of the holding member and the relation of $R_P > R_H$ is established. When the holding member is inserted in the preliminarily drawn cup at the redrawing step and the blank holding force acts on the cup, as shown in FIGS. 3-A and 3-B, if the peripheral curved portion of the bottom of the preliminarily drawn cup is expanded outwardly in the radial direction of the cup, because of the above-mentioned difference of the optimum range, a tensile deformation is caused in the above portion in the circumferential direction, with the result that local reduction of the thickness is caused. If a coating is formed in advance on the inner face or outer face of the metal sheet, it is apprehended that damages such as cracks will be formed on the coating. In contrast, according to the present invention, even if there is a difference between $R_P$ and $R_H$, since a compression deformation as mentioned above is caused on the working face 4*a*, the radius $R_H$ of the corner portion 3C of the holding member can be set within the optimum range even under severe conditions imposed on the preliminarily drawn cup. Furthermore, the local reduction of the thickness and the sequential damage of the coating can be effectively avoided. In the present invention, it is preferred that the radius $R_H$ of the corner portion of the holding member be 3 to 20 times, especially 4 to 12 times, as large as the sheet thickness.

If $R_H$ is too small and below the above-mentioned range, the bending resistance imposed when the material is introduced into the clearance of the blank holding face becomes large, and fracture of the material is often caused. If $R_H$ is too large, the quantity of an uncontrollable deformation of this portion becomes large and wrinkles are easily formed. In case of thickness-reducing redraw forming where the thickness of the side wall of the can barrel is uniformly reduced by application of not only a bending-unbending deformation but also a tensile stress at the radius portion of the die, it is especially important to set $R_H$ at an appropriate value, and it is preferred that $R_H$ be adjusted to a relatively small value within a range not causing breaking of the barrel, that is, 4 to 12 times the sheet thickness.

Furthermore, in the state where the side wall of the cup receives back tensions from the large-diameter terminal corner portion 3B of the holding member, the working face 4A of the annular member and the small-diameter terminal corner portion 3C of the holding member, the side wall of the cup undergoes a tensile bending deformation at the corner portion 2A of the redrawing die. This co-operation of the back tensions exerts a functional effect valuable for uniformly reducing the thickness of the cup. According to the present invention, just before the material is introduced into the clearance of the blank holding face, forming of diminishing the diameter of the cup is performed by the annular member, and the deformation-resisting force acting at this point acts effectively as the back tension. In the case where in the present invention, it is intended to obtain a thickness reduction ratio comparable to the thickness reduction ratio attained in the conventional method, the radius $R_D$ of the corner portion 2A of the redrawing die and the radius $R_H$ of the corner portion 3C of the holding member can be made larger than in the conventional method and the blank holding force can be set at a smaller value than in the conventional method. Therefore, according to the present invention, a cup having a drastically reduced damage can be obtained. It also is important that the diameter of the working portion 4A of the annular member should be smaller by 1 to 6%, especially 2 to 5%, than the outer diameter of the preliminarily drawn cup. The diameter diminishment ratio $\delta$ of the cup at the working portion of the annular member has an optimum range. The radius diminishment ratio $\delta$ referred to herein is a value defined by the following formula:

$$\delta = \left\{ 1 - \frac{\text{inner diameter of annular working member}}{\text{outer diameter of cup before forming}} \right\} \times 100\ (\%)$$

If $\delta$ is too large, the tendency of formation of wrinkles increases, and the deformation-resisting force in the annular member increases, resulting in breaking of the barrel. If $\delta$ is too small, the intended effect of the present invention cannot be sufficiently attained. Therefore, in the present invention, the inner diameter of the annular member is adjusted within the above-mentioned range.

Moreover, when the diameter of the preliminarily drawn cup is diminished by the annular member, there also is present an optimum range for the angle $\theta$ between the tapered portion of the cup and the central axis, and if the angle $\theta$ is above or below this optimum range, forming troubles such as wrinkling are caused. In the present invention, it is preferred that the angle $\theta$ be in the range of from 15° to 45°.

In the present invention, it also important that the side wall of the cup should be subjected to bending-unbending at the large-diameter terminal corner portion 3B of the holding member and the working portion 4B, as pointed out hereinbefore. More specifically, in the preliminarily drawn cup having the side wall where working hardening is caused, the hardness is once reduced by the diminishment of the diameter by the annular working member, and subsequently, while the cup is introduced into the clearance of the blank holding face and is passed through the die radius portion, work hardening is effected again. The hardness of the side wall of the formed can barrel according to the present invention is lower than the hardness of the cup formed into the same shape according to the conventional redrawing method. Therefore, even in case of a highly processed draw-redraw-formed can, according to the present invention, post treatments such as bending, necking and flanging can be facilitated. Moreover, the cup provided according to the present invention, the double seaming operation for filling a content can be advantageously performed.

Incidentally, this functional effect is attained if the diameter diminishment ratio of the cup at the working portion is within the range of from 1 to 6%.

Figure 2:
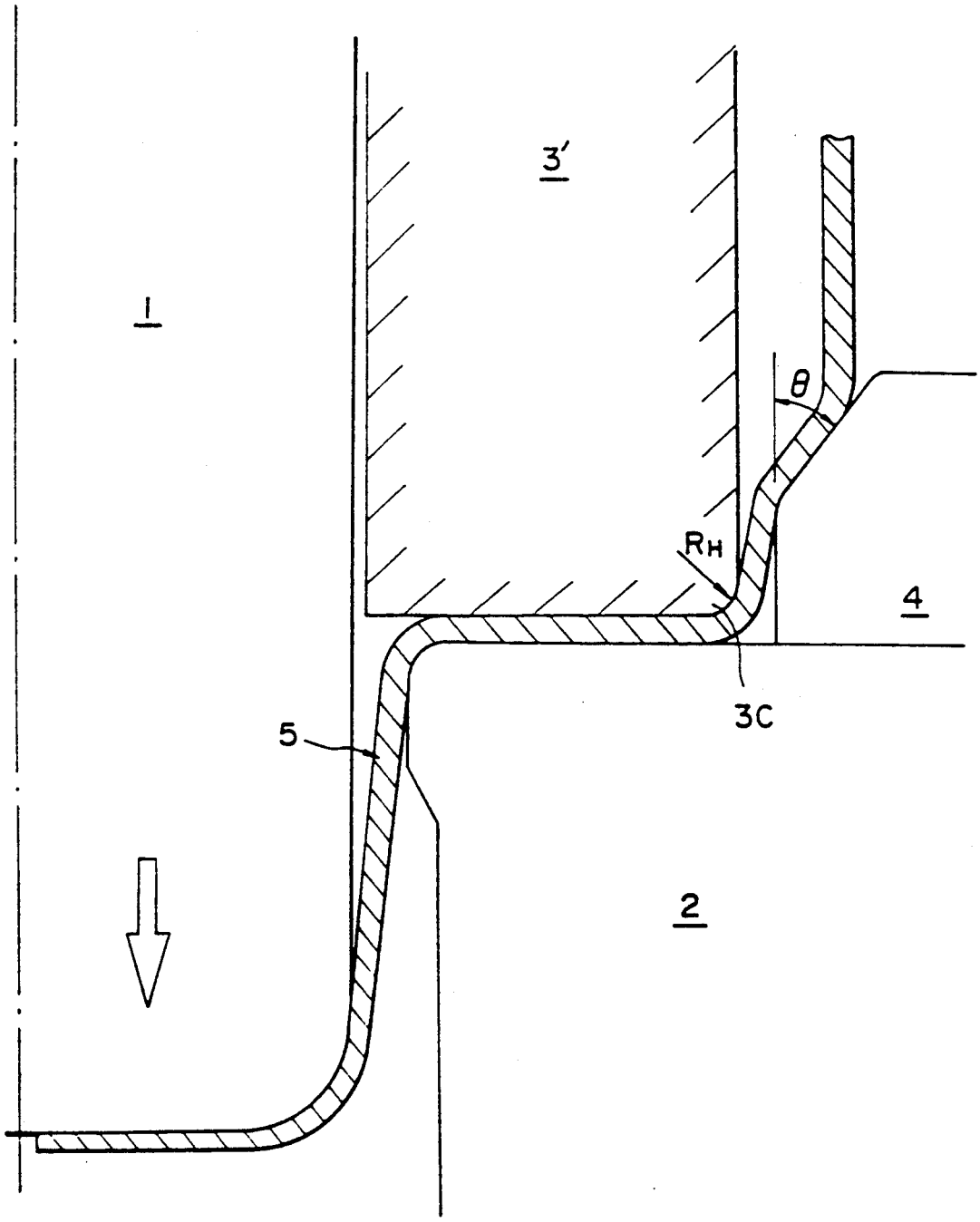

In the case where a relatively soft metal sheet or a relatively thick metal sheet is used, the present invention can also be worked by using a holding member 3' having neither a large-diameter portion 3D having a diameter almost equal to or slightly smaller than the inner diameter of the preliminarily drawn cup 5 nor a large-diameter terminal corner portion 3B, as shown in FIG. 2. In this case, there is preferably disposed means for guiding the preliminarily drawn cup at the point of the forming of the preliminarily drawn cup so that the central axis of the preliminarily drawn cup is in agreement with the central axes of the punch and the holding member.

In the present invention, various surface-treated steel sheets and sheets of light metals such as aluminum an be used as the metal sheet.

As the surface-treated steel sheet, there can be used steel sheets obtained by annealing a cold-rolled steel sheet, subjecting the annealed steel sheet to the secondary cold rolling and then subjecting the steel sheet to at least one of surface treatments such as zinc plating, tin plating, nickel plating, electrolytic chromate treatment and chromate treatment. As a preferred example of the surface-treated steel sheet, there can be mentioned an electrolytically chromate-treated steel sheet, especially one having 10 to 200 mg/m$^2$ of a metallic chromium layer and 1 to 50 mg/m$^2$ (calculated as metallic chromium) of a chromium oxide layer. This steel sheet is excellent in the combination of the coating adhesion and corrosion resistance. As another example of the surface-treated steel sheet, there can be mentioned a hard tinplate sheet having a tin deposition amount of 0.5 to 11.2 g/m$^2$. Preferably, this tinplate sheet is subjected to the chromate treatment or the chromate/phosphate treatment so that the chromium amount is 1 to 30 mg/m$^2$ as metallic chromium. As still another example, there can be mentioned an aluminum-coated steel sheet formed by deposition or cladding aluminum.

Not only a so-called pure aluminum sheet but also an aluminum alloy sheet can be used as the light metal sheet. An aluminum alloy sheet having a high corrosion resistance and an excellent workability comprises 0.2 to 0.5% by weight of Mn, 0.8 to 5% by weight of Mg, 0.25 to 0.3% by weight of Zn and 0.15 to 0.25% by weight of Cu, the balance being Al. Preferably, these light metal sheets are subjected to the chromate treatment or the chromate/phosphate treatment so that the chromium amount is 20 to 300 mg/m$^2$ as metallic chromium.

The blank thickness ($t_B$) of the metal sheet is changed according to the kind of the metal and the use and size of the final vessel, but it is generally preferred that the blank thickness be 0.10 to 0.50 mm, especially 0.10 to 0.30 mm in case of a surface-treated steel sheet or 0.15 to 0.40 mm in case of a light metal sheet.

The present invention is advantageous in that if a protecting coating of a resin is formed on a metal sheet prior to draw forming, deep-draw forming and uniform reduction of the thickness can be performed without substantial damage of the protecting covering layer. Formation of the protecting coating can be accomplished by coating a protecting paint or laminating a thermoplastic resin film on the metal sheet.

Protecting paints composed of thermosetting and thermoplastic resins can be optionally used as the protecting paint. For example, there can be mentioned modified epoxy paints such as a phenol-epoxy paint and an amino-epoxy paint, vinyl and modified vinyl paints such as a vinyl chloride/vinyl acetate copolymer paint, a partially saponified vinyl chloride/vinyl acetate copolymer paint, a vinyl chloride/vinyl acetate/maleic anhydride copolymer paint, an epoxy-modified vinyl paint, an epoxyamino-modified vinyl paint and an epoxy-phenol-modified vinyl paint, acrylic resin paints, and synthetic rubber paints such as a styrene/butadiene copolymer paint. These paints can be used singly or in the form of mixtures of two or more of them.

A paint as mentioned above is applied to a metal blank in the form of an organic solvent solution such as an enamel or lacquer or in the form of an aqueous dispersion or solution by roller coating, spray coating, dip coating, electrostatic coating or electrophoretic deposition. In case of a thermosetting resin paint, the coated paint is baked according to need. In view of the corrosion resistance and workability, it is preferred that the thickness (in the dry state) of the coating be 2 to 30 μm, especially 3 to 20 μm. A lubricant can be incorporated in the coating for improving the draw-redraw formability.

As the thermosetting resin film used for the lamination, there can be mentioned films of olefin resins such as polyethylene, polypropylene, an ethylene/propylene copolymer, an ethylene/vinyl acetate copolymer, an ethylene/acrylic ester copolymer and an ionomer, films of polyesters such as polyethylene terephthalate, polybutylene terephthalate and an ethylene terephthalate/isophthalate copolymer, films of polyamides such as nylon 6, nylon 6,6, nylon 11 and nylon 12, and a polyvinylidene chloride film. These films may be undrawn films or biaxially drawn films. Preferably, the thickness of the thermoplastic resin film is 3 to 50 μm, especially 5 to 40 μm. Lamination of the film on the metal sheet can be accomplished by heat fusion bonding, dry lamination, extrusion coating or the like. In the case where the adhesiveness (heat fusion bondability) between the film and the metal sheet is poor, for example, a urethane type adhesive, an epoxy type adhesive, an acid-modified olefin resin adhesive, a copolyamide type adhesive, a copolyester type adhesive or the like can be interposed between the metal and the metal sheet.

In order to hide the metal sheet or assist the transmission of the blank holding force to the metal sheet at the draw-redraw forming step, an inorganic filler (pigment) can be incorporated into the coating or film used in the present invention.

As the inorganic filler, there can be mentioned inorganic white pigments such as rutile or anatase titanium dioxide, zinc flower and gloss white, white extender pigments such as barite, precipitated barite sulfate, calcium carbonate, gypsum, precipitated silica, aerosil, talc, fired or unfired clay, barium carbonate, alumina white, synthetic or natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Figure 5:
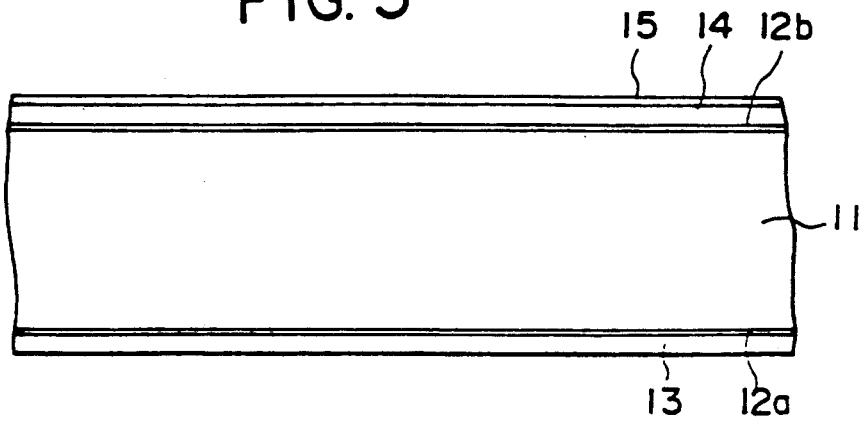
FIG. 5 is a diagram illustrating an example of the material used in the present invention.

FIG. 5 shows an example of the coated metal sheet preferably sued in the present invention. Chemical conversion coatings 12*a* and 12*b* such as chromate treated films are formed on both the surfaces of a metal substrate 11, and an inner face coating 13 is formed on the surface to be formed into the inner face of the can, through the chemical conversion coating 12*a*. An outer face coating comprising a white coating 14 and a transparent varnish 15 is formed on the surface to be formed into the outer face of the can, through the chemical conversion coating 12*b*.

Figure 6:
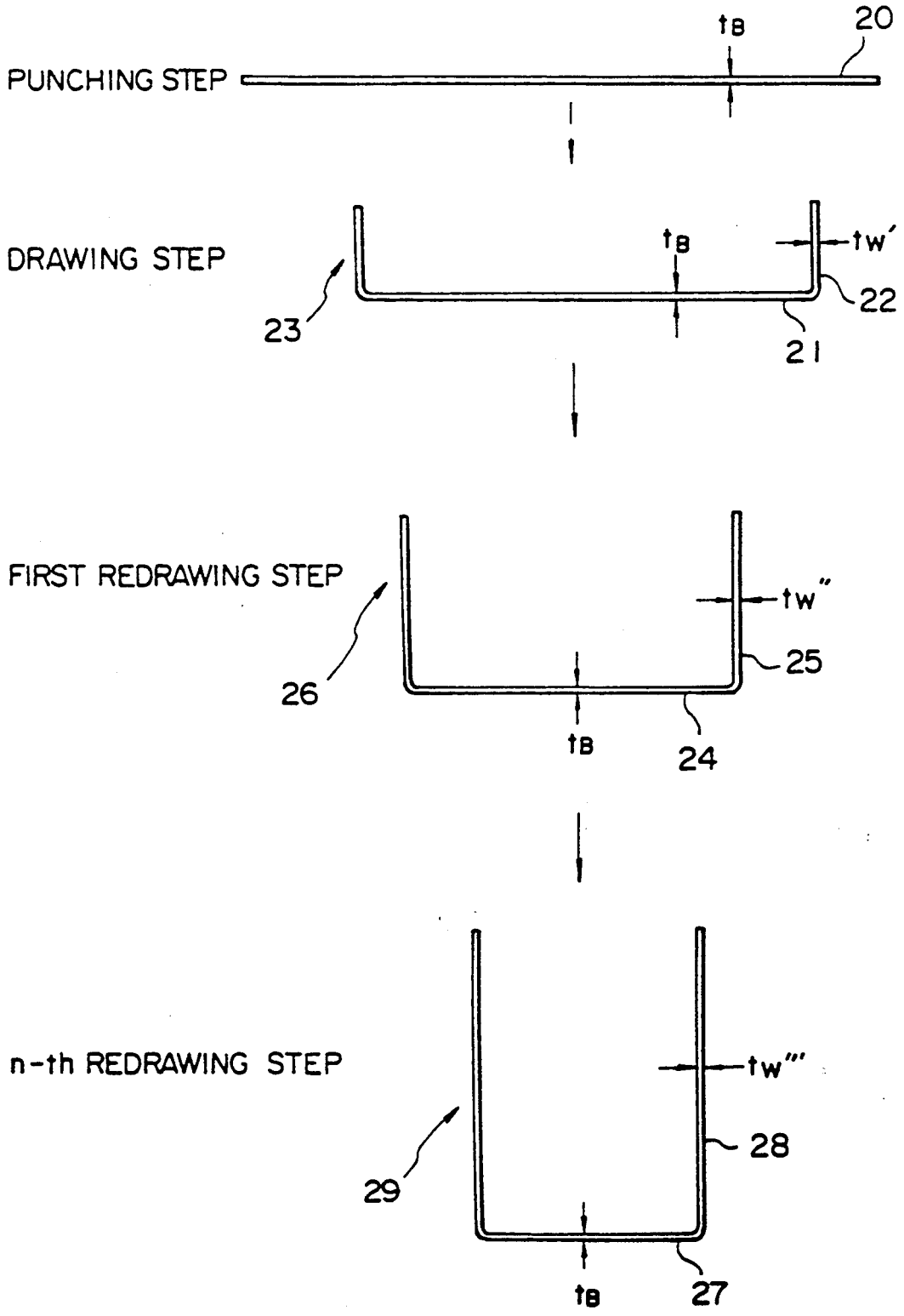
FIG. 6 is a diagram illustrating the drawing and redrawing process.

Referring to FIG. 6 illustrating the forming process of the present invention, a coated metal sheet as mentioned above is punched into a disk 20 having a thickness $t_B$ at the punching step. Then, at the subsequent drawing step, the disk is draw-formed into a shallowly drawn cup 23 comprising a bottom 21 having a large diameter and a thickness $t_B$ and a side wall 22 having a thickness tw'. At this drawing step, the draw ratio defined by the following formula:

$$\text{draw ratio} = \frac{\text{diameter of blank}}{\text{diameter of drawn can}}$$

is preferably in the range of from 1.2 to 1.9, especially preferably from 1.3 to 1.8. The thickness tw' of the side wall 22 is slightly larger than $t_B$.

Then, at the first redrawing step, the shallowly drawn cup 23 is subjected to redraw forming by an apparatus as shown in FIG. 1.

As shown in FIG. 1, in the redrawing method of the present invention, the redrawing punch 1, the redrawing die 2, the holding member 3 and the annular working member 4 are used. Preferably, the diameter of the redrawing punch 1 is 1/1.2 to 1/1.9 of the inner diameter of the preliminarily drawn cup 5. If this requirement is satisfied, a sufficient blank holding face can be secured. The top end face 2A of the redrawing die 2 is formed as the die flat face, and the radius of the corner portion 2B exerting a tensile bending action on the cup 5 is adjusted to 1 to 20 times the sheet thickness, preferably 1 to 4 times the sheet thickness when reduction of the thickness is especially intended.

In the holding member 3, the diameter is reduced in the lower end portion. The diameter of the large-diameter portion is substantially equal to the inner diameter of the cup 5. The inner face of the side wall of the cup abuts against the large-diameter corner portion 3B and small-diameter corner portion 3C of the holding member 3, and the radius $R_H$ of the small-diameter portion 3C is the blank holder radius. This radius $R_H$ is adjusted to 3 to 20 times the sheet thickness, preferably 4 to 12 times the sheet thickness when reduction of the thickness is especially intended.

The annular member 4 can be fixed to the top end face of the redrawing die or be formed integrally with the redrawing die. Alternatively, the annular member 4 can be arranged independently from the redrawing die. A working portion 4A is formed on the annular member 4 and a tapered face is formed at the upper part thereof. The diameter of the working portion 4A is diminished by 1 to 6%, preferably 1 to 5%, of the diameter of the preliminarily drawn cup 5. The face of the cup being tapered at the diminishment of the diameter forms an angle $\theta$ to the central axis, and it is preferred that the angle $\theta$ be 15° to 45°, especially 20° to 40°.

By using the above-mentioned apparatus, a redraw-formed cup 26 comprising a bottom 24 having a thickness $t_B$ and a diameter smaller than that of the shallowly drawn cup and a side wall 25 having a thickness tw'' and a height larger than that of the shallowly drawn cup is prepared. The side wall 25 of the redraw-formed cup 26 is bent and elongated so that the thickness tw'' is smaller than $t_B$ and tw'.

In general, this redrawing process is conducted in a plurality of stages, and if the redrawing is carried out in a plurality of stages, the thickness of the side wall is reduced and the thickness of the entire side wall is made more uniform. At the final n-th redrawing step, a deep-draw-formed can 29 comprising a small-diameter bottom 27 having a thickness $t_B$ and a higher side wall having a thickness tw''' is obtained.

Figure 4:
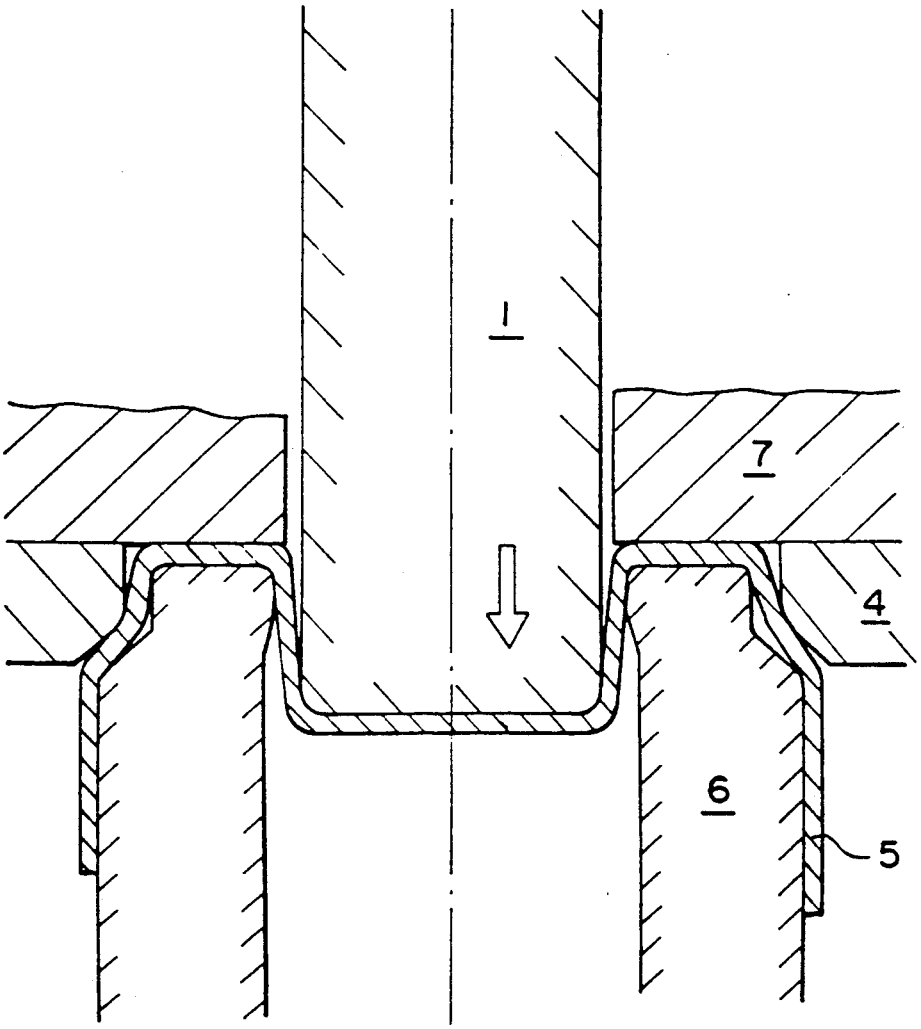
FIG. 4 is a sectional partial view illustrating an embodiment in which the method of the present invention is worked as the reverse redraw-forming method.

Incidentally, the present invention is applied to not only the so-called sequential redrawing but also the so-called reverse redrawing. An embodiment where the present invention is applied to the latter redrawing is illustrated in FIG. 4.

It is preferred that the draw forming and redraw forming be carried out after a lubricant has been coated on the coated metal sheet or the preliminarily drawn cup. As the lubricant, there can be used liquid paraffin, synthetic paraffin, edible oil, hydrogenated edible oil, palm oil, natural waxes and polyethylene wax. The amount coated of the lubricant is changed according to the kind of the lubricant, but it is generally preferred that the amount coated of the lubricant be 0.1 to 10 mg/dm$^2$, especially 0.2 to 5 mg/dm$^2$. Coating of the lubricant can be accomplished by spraying the lubricant in the melted state on the surface of the metal sheet or cup.

The draw forming can be carried out at room temperature, but it is preferred that the draw forming be carried out at a temperature of 20° to 95° C., especially 20° to 90° C.

Of course, the method of the present invention can be conducted at the redrawing step in the process of the production of a draw-ironed can (so-called DI can).

The obtained can is formed into a can barrel for a two-piece can through various processings such as flange trimming, doming, necking and flanging.

According to the present invention, by arranging an annular working member having a working portion having an inner diameter smaller than the outer diameter of the side wall of the preliminarily drawn cup on the face of the redrawing die, passing the preliminarily drawn cup through the working member to reduce the diameter and carrying out redrawing by delivering the cup to the portion of engagement between the blank holder face and the redrawing die, a redraw-formed cup having a uniformly and sufficiently reduced thickness can be obtained without damage of the metal sheet or coating layer. Furthermore, since the bending-unbending operation is carried out in advance before the redraw forming, work hardening is controlled in the redraw-formed cup and therefore, post treatments of the redraw-formed cup, such as necking, can be performed very easily.

The present invention will now be described in detail with reference to the following examples.

EXAMPLE 1

An epoxy type thermosetting paint was coated and baked on both the surfaces of a tin-free steel sheet (tempering degree of DR-9) having a blank thickness of 0.18 mm to form a protecting coating having a dry thickness of about 20 μm on each surface, and palm oil was coated and the coated sheet was punched into a disk having a diameter of 179 mm. The disk was formed into a shallowly drawn cup between a drawing punch and a drawing die according to customary procedures.

The draw ratio at this drawing step was 1.42.

At first, second and third redrawing steps, redraw forming was carried out by using the apparatus shown in FIG. 1.

The redraw ratios adopted at the first, second and third redrawing steps were as follows.

First redraw ratio: 1.29

Second redraw ratio: 1.24

Third redraw ratio: 1.20

At each redrawing step, the curvature ($R_D$) of the working corner portion of the redrawing die was 0.6 mm and the curvature radius ($R_H$) of the working corner portion of the holding member was 1.5 mm.

The ratio δ of the diminishment of the diameter by the annular member and the tapering angle $\theta$ of the material at the diminishment of the diameter were as follows.

| | δ | θ |
|---|---|---|
| First redrawing | 3% | 35° |
| Second redrawing | 4% | 35° |
| Third redrawing | 5% | 35° |

The blank holding load at the forming was 3,000 Kg.

The characteristics of the obtained deep-draw-formed cup were as follows.

Cup diameter: 66 mm

Cup height: 130 mm

Average thickness change ratio of side wall: −20%

Then, doming and trimming were carried out according to customary procedures, and thin, necking was carried out by using an ordinary necking die having an inner diameter smaller than the outer diameter of the cup. No significant defects were found. When the Vickers hardness of the portion close to the trimmed part of the cup before necking was observed, it was found that the hardness HV was 225 while the hardness HV of the starting sheet was 190, and it was confirmed that work hardening was not conspicuously advanced.

Then, flanging was carried out, and degreasing and washing were then conducted. Thus, a can barrel for a two-piece can was obtained.

In order to check damage of the protecting coating of the final can barrel, the degree of the exposure of the metal was measured. The enamel rater value was smaller than 0.1 mA.

The redraw-formed can was cold-filled with (A) cola, (B) beer or (C) synthetic carbonated drink, and a metal lid was double-seamed to the filled can. Then, the so-prepared three vessels were heat-sterilized under conditions shown in Table 1.

TABLE 1

| Vessel | Apparatus | Temperature | Spontaneous Pressure |
|---|---|---|---|
| (A) | can warmer | 42° C. | 7.0 kg/cm$^2$ |
| (B) | pasterizer | 62° C. | 6.2 kg/cm$^2$ |
| (C) | can warmer | 42° C. | 8.0 kg/cm$^2$ |

These three filled can vessels were stored at room temperature of 37° C. for a long period, and the corrosion of the inner face of the can was observed and the corrosion resistance was evaluated. The obtained results are shown in Table 2. As is seen from the results shown in Table 2, no trouble was found in any vessel, and interfacial corrosion was not caused at all.

TABLE 2

| | | Storage Period | | | | | |
|---|---|---|---|---|---|---|---|
| | | 1 month | | 3 months | | 6 months | |
| Content | Evaluation Item | corrosion | leakage | corrosion | leakage | corrosion | leakage |
| Cola | | ○ | 0/100 | ○ | 0/100 | ○ | 0/100 |
| Beer | | ○ | 0/100 | ○ | 0/100 | ○ | 0/100 |
| Synthetic Carbonated Drink | | ○ | 0/100 | ○ | 0/100 | ○ | 0/100 |

Note
○: no corrosion

COMPARATIVE EXAMPLE 1

An epoxy type thermosetting paint was coated and baked on both the surfaces of a tin-free steel sheet (tempering degree of DR-9) having a blank thickness of 0.18 mm to form a protecting coating having a dry thickness of about 20 μm on each surface, and palm oil was coated and the coated sheet was punched into a disk having a diameter of 179 mm. The disk was formed into a shallowly drawn cup between a drawing punch and a drawing die according to customary procedures.

The draw ratio at this drawing step was 1.42.

Figure 7:
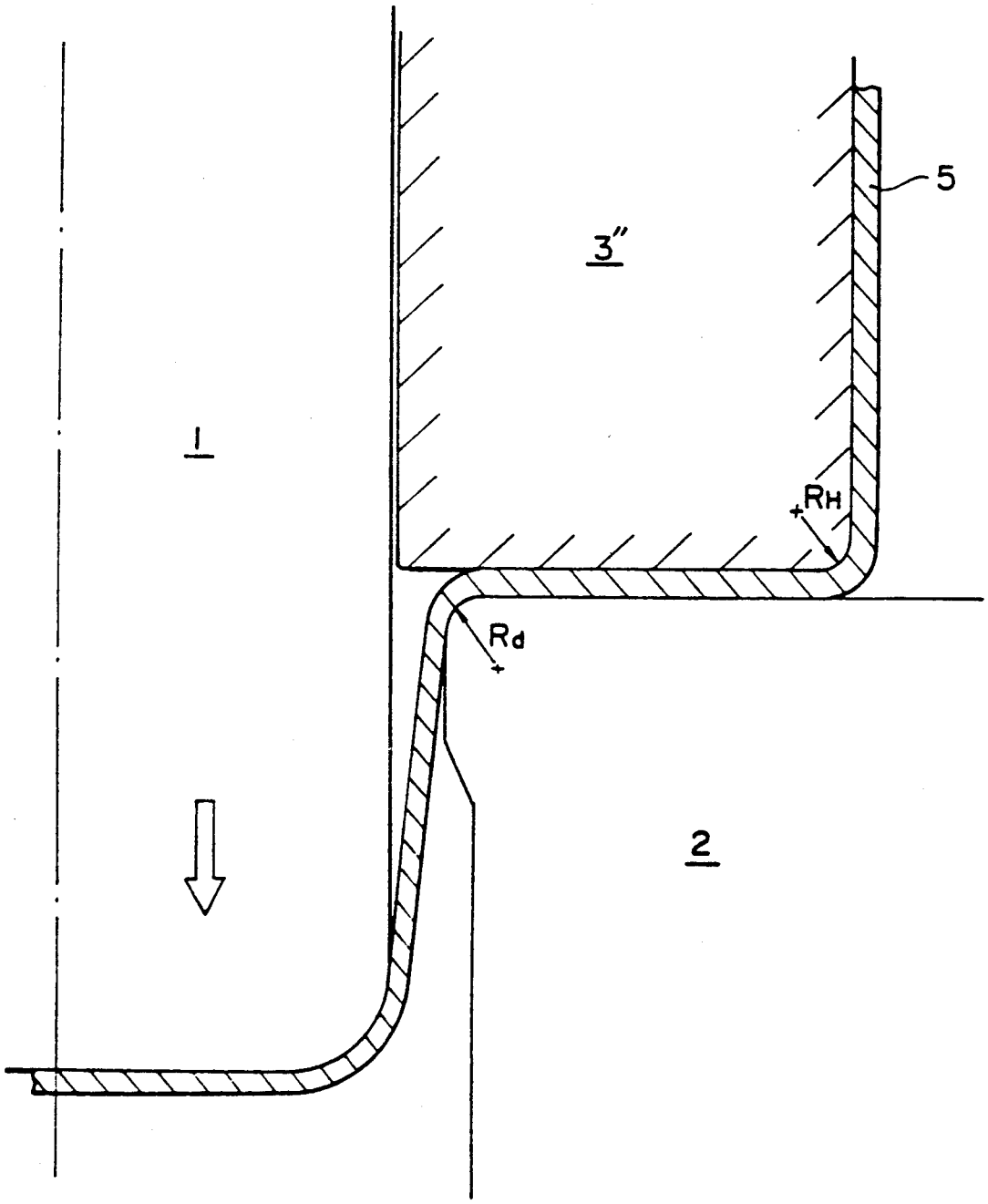
FIG. 7 is a diagram illustrating Comparative Example 1 given hereinafter.

At first, second and third redrawing steps, redraw forming was carried out by using the apparatus shown in FIG. 7.

The redraw ratios adopted at the first, second and third redrawing steps were as follows.

First redraw ratio: 1.29

Second redraw ratio: 1.24

Third redraw ratio: 1.20

At each redrawing step, the curvature ($R_D$) of the working corner portion of the redrawing die was 0.4 mm and the curvature radius ($R_H$) of the working corner portion of the holding member was 1.3 mm.

The blank holding load at the forming was 3,000 Kg.

The characteristics of the obtained deep-draw-formed cup were as follows.

Cup diameter: 66 mm

Cup height: 130 mm

Average thickness change ratio of side wall: −20%

Accordingly, the size of the obtained cup was substantially the same as that of the cup obtained in Example 1.

In order to check damage of the protecting coating of the final can barrel, the degree of the exposure of the metal was measured. It was found that the enamel rater value of the entire vessel was 10 mA, the enamel rater value of the upper part of the side wall was 7 mA and the enamel rater value of the lower part of the side wall was 3 mA. Accordingly, it was confirmed that the protecting coating at the upper part of the side wall was considerably damaged.

Then, doming and trimming were carried out according to customary procedures, and then, necking was carried out by using an ordinary necking die having an inner diameter smaller than the outer diameter of the cup. Many wrinkles were formed in the worked portion and buckling was caused in an extreme case.

When the Vickers hardness of the portion close to the trimmed part of the cup before necking was observed, it was found that the hardness HV was 240 while the hardness HV of the starting sheet was 190, and it was confirmed that work hardening was conspicuously advanced.

EXAMPLE 2

A coated metal sheet was prepared by bonding a polyethylene terephthalate (PET) film (having a thickness of 20 μm, a glass transition temperature of 70° C. and a melting point of 255° C.) to both the surfaces of a tin-free steel (TFS) sheet having a blank thickness of 0.18 mm and a tempering degree of DR-9.

The coated steel sheet was redraw-formed in the same manner as described in Example 1. A can barrel having substantially the same shape as that of the can barrel obtained in Example 1 was obtained.

The obtained deep-draw-formed can was washed and heat-treated, degreased and washed according to customary procedures. Then, trimming, printing (baking at 205° C. for 2 minutes), necking and flanging were conducted.

In order to check damage of the protecting coating of the final can barrel, the degree of the exposure of the metal was measured. The enamel rater value was smaller than 0.1 mA.

Then, the adhesion strength of the polyethylene terephthalate film as the coating material was measured according to the method in which the barrel portion was cut out in a width of 5 mm along the can height direction from the obtained final redraw-formed can barrel and 90° peel strength of the film was determined.

It was found that the adhesion strength was 0.17 to 0.56 kg/mm and there was no practical problem.

COMPARATIVE EXAMPLE 2

The coated metal sheet used in Example 2 was redraw-formed in the same manner as described in Comparative Example 1, whereby a can barrel having substantially the same shape as that of the can barrel obtained in Example 1 was obtained. Peeling deemed to be due to reduction of the adhesive force was caused at parts of the coatings on the inner and outer faces of the can barrel, and this peeling was especially conspicuous in the upper portion of the can barrel. Accordingly, the subsequent can-manufacturing operations became impossible.

EXAMPLE 3

A bright tin-deposited steel sheet having a blank thickness of 0.29 mm and a tin deposition amount of #25/#25 (the tempering degree was T-2.5) was punched into a disk having a diameter of about 145 mm, and the disk was formed into a cup having a diameter of about 80 mm by a drawing punch and a drawing die according to customary procedures.

Redraw forming of this cup was carried out by using the apparatus shown in FIG. 1. The redraw ratio adopted was 1.21. The diameter diminishment ratio $\delta$ was 3.5% and the tapering angle $\theta$ was 30°. The obtained cup having an inner diameter of about 66 mm was subjected to three-staged ironing between a punch and an ironing die. The obtained can barrel had an excellent dimensional precision. There was no problem about the surface properties on the outer face side.

EXAMPLE 4

A laminated sheet was prepared in the following manner.

A cold-rolled steel sheet strip having a thickness of 0.30 mm, a tempering degree of T-2.5 and a width of 300 mm was subjected to a known electrolytic chromate treatment, whereby a coating comprising 0.017 $g/m^2$ as chromium of an upper chromium oxide hydrate layer and 0.10 $g/m^2$ of a lower metallic chromium layer was formed on one surface of the steel sheet strip. then, 5.6 $g/m^2$ of tin was deposited on the other surface of the steel sheet strip. Then, the surface-treated steel sheet strip was heated at 220° C. by using a roll heater, and a biaxially oriented polyester film (polycondensate of ethylene glycol with 80% of terephthalaic acid and 20% of isophthalaic acid) having a thickness of 25 $\mu m$ was laminated on the surface having the chromium oxide hydrate layer and immediately, the laminated steel sheet strip was water-cooled. The obtained polyester resin-coated steel sheet was subjected to draw-ironing under the same forming conditions as described in Example 3 so that the polyester resin-coated surface became the inner face of the obtained DI can.

The obtained can barrel had an excellent dimensional precision, and there was no problem about the surface properties on the outer face side. Furthermore, the coating on the inner face side had no defect.

We claim:

1. In a method for redrawing a metal cup, which comprises holding a preliminary drawn cup of a metal sheet by a cup-holding member inserted in the cup and a flat face portion of a redrawing die, and relatively moving the redrawing die and a redrawing punch arranged coaxially with the holding member and the redrawing die and movably within the holding member, an improvement wherein an annular working member coaxial with the cup-holding member, which has a working face having an inner diameter smaller than the outer diameter of the side wall of the preliminarily drawn cup, is arranged on the introduction side of the flat face portion of the redrawing die, and wherein the outer surface of the side wall of the preliminarily drawn cup is engaged with the working face of the annular member while maintaining the inner surface of the side wall of the preliminarily drawn cup in a state free from the cup-holding member, thereby to diminish the outer diameter of the preliminarily drawn cup by 1 to 6% prior to redraw forming, and subsequently, redraw forming of the cup by the redrawing die and the redrawing punch while a blank holding force is applied to the cup by the holding member and the flat face portion of the redrawing die.

2. A redrawing method according to claim 1, wherein the outer diameter of the preliminarily drawn cup is diminished by 1 to 5% by the annular working member.

3. A redrawing method according to claim 1, wherein the radius, on the side of the annular working member, of the holding member is 3 to 20 times the thickness of the metal sheet.

4. A redrawing method according to claim 1, wherein the radius of a corner portion having a tensile bending action in the redrawing die is 1 to 20 times the thickness of the metal sheet.

5. A redrawing method according to claim 1, wherein the metal sheet is a coated metal sheet having a protecting resin coating.

* * * * *